US011029065B2

(12) United States Patent
Molavi

(10) Patent No.: US 11,029,065 B2
(45) Date of Patent: Jun. 8, 2021

(54) MULTI-STAGE OIL BATCH BOILING SYSTEM

(71) Applicant: Carrier Corporation, Palm Beach Gardens, FL (US)

(72) Inventor: Anthony S. Molavi, Mooresville, NC (US)

(73) Assignee: Carrier Corporation, Palm Beach Gardens, FL (US)

( * ) Notice: Subject to any disclaimer, the term of this patent is extended or adjusted under 35 U.S.C. 154(b) by 270 days.

(21) Appl. No.: 15/767,845

(22) PCT Filed: Oct. 14, 2016

(86) PCT No.: PCT/US2016/057047

§ 371 (c)(1),
(2) Date: Apr. 12, 2018

(87) PCT Pub. No.: WO2017/066575

PCT Pub. Date: Apr. 20, 2017

(65) Prior Publication Data

US 2018/0306472 A1 Oct. 25, 2018

Related U.S. Application Data

(60) Provisional application No. 62/241,994, filed on Oct. 15, 2015.

(51) Int. Cl.

| | |
|---|---|
| ***F25B 31/00*** | (2006.01) |
| ***F25B 43/02*** | (2006.01) |
| ***F25B 49/02*** | (2006.01) |

(52) U.S. Cl.

CPC ..... *F25B 31/004* (2013.01); *F25B 43/02* (2013.01); *F25B 49/02* (2013.01); *F25B 2400/09* (2013.01); *F25B 2500/16* (2013.01)

(58) Field of Classification Search

CPC ..... F25B 31/004; F25B 49/02; F25B 43/02; F25B 2400/09; F25B 2500/16; F25B 2313/008; F25B 2313/001

(Continued)

(56) References Cited

U.S. PATENT DOCUMENTS 2,223,882 A 12/1940 Beline
2,411,539 A * 11/1946 Gunn ..... B01D 35/12 184/6.24

(Continued)

FOREIGN PATENT DOCUMENTS

CN 1123899 A 6/1996
CN 1692262 A 11/2005

(Continued)

OTHER PUBLICATIONS

European Office Action dated Feb. 12, 2019 for European Patent Application No. 6788340.4.

(Continued)

*Primary Examiner* — Larry L Furdge
*Assistant Examiner* — Kirstin U Oswald
(74) *Attorney, Agent, or Firm* — Bachman & LaPointe, P.C.

(57) ABSTRACT

A vapor compression system (20) comprises: a compressor (24) having a suction port (26) and a discharge port (28); a refrigerant flowpath (33) from the discharge port and returning to the suction port; a first heat exchanger (30) along the refrigerant flowpath; a second heat exchanger (50) along the refrigerant flowpath; and a vaporizer system (22; 300). The vaporizer system comprises: a first vaporizer (68A; 368A) and a second vaporizer (68B: 368B) each comprising: a vessel (86; 386) having an inlet (84), a vapor outlet (124), and a liquid outlet (130); and a gas bypass flowpath (160) in heat transfer relation with an interior of the vessel.

21 Claims, 5 Drawing Sheets

(58) Field of Classification Search
USPC ..... 62/84, 238.4, 512
See application file for complete search history.

(56) References Cited

U.S. PATENT DOCUMENTS

| | | | | |
|---|---|---|---|---|
| 2,480,693 | A * | 8/1949 | Aronson | F25B 23/00 62/79 |
| 2,632,304 | A * | 3/1953 | White, Jr. | F25B 47/022 62/155 |
| 2,635,304 | A * | 4/1953 | Peters | E05B 69/00 211/4 |
| 2,663,164 | A * | 12/1953 | Kurtz | F25B 31/002 62/468 |
| 2,798,570 | A * | 7/1957 | Kelley | F24F 3/1417 95/18 |
| 2,894,376 | A * | 7/1959 | Kelley | F24F 3/1417 62/271 |
| 3,052,223 | A * | 9/1962 | Profos | F01K 3/24 122/479.6 |
| 3,434,410 | A * | 3/1969 | Galle | F26B 7/00 99/472 |
| 4,530,215 | A * | 7/1985 | Kramer | F25B 31/002 62/468 |
| 4,646,527 | A * | 3/1987 | Taylor | F25B 45/00 62/149 |
| 5,182,919 | A * | 2/1993 | Fujiwara | F04D 29/063 62/193 |
| 5,605,058 | A * | 2/1997 | Kurachi | F25B 31/004 62/193 |
| 5,651,257 | A * | 7/1997 | Kasahara | C10M 171/008 62/84 |
| 5,947,711 | A * | 9/1999 | Myers | B01D 45/08 418/85 |
| 6,082,982 | A | 7/2000 | Rosser, Jr. et al. | |
| 6,341,612 | B1 * | 1/2002 | Duckett | C23G 3/00 134/103.1 |
| 6,550,258 | B1 * | 4/2003 | Shoulders | F04C 28/06 62/472 |
| 6,672,102 | B1 * | 1/2004 | Huenniger | F25B 1/047 62/472 |
| 7,069,740 | B2 * | 7/2006 | Lee | F25B 13/00 55/424 |
| 8,640,491 | B2 | 2/2014 | Shoulders | |
| 9,032,754 | B2 | 5/2015 | Love et al. | |
| 2003/0156939 | A1 * | 8/2003 | Evans | F04B 39/0207 415/26 |
| 2008/0271477 | A1 * | 11/2008 | Holmes | F25B 31/004 62/468 |
| 2009/0126376 | A1 | 5/2009 | Knoll | |
| 2014/0174112 | A1 * | 6/2014 | Molavi | F25B 31/004 62/84 |
| 2015/0037183 | A1 | 2/2015 | Rood et al. | |

FOREIGN PATENT DOCUMENTS

| | | | |
|---|---|---|---|
| CN | 101520376 | A | 9/2009 |
| CN | 101949619 | B | 10/2012 |
| CN | 103528141 | A | 1/2014 |
| CN | 203771585 | U | 8/2014 |
| CN | 104713195 | A | 6/2015 |
| EP | 0672875 | A2 | 9/1995 |
| EP | 2886977 | A1 | 6/2015 |
| JP | H08189730 | A | 7/1996 |
| JP | 2013257081 | A | 12/2013 |
| WO | 2013/032611 | A2 | 3/2013 |
| WO | 2014/176776 | A1 | 11/2014 |
| WO | 2014/204745 | A1 | 12/2014 |
| WO | 2015069373 | A1 | 5/2015 |

OTHER PUBLICATIONS

Hermetic Screw Liquid Chillers with PIC III Controls, Start-Up, Operation and Maintenance Instructions, Sep. 11, 2006, Carrier Corporation, Jupiter, Florida.

International Search Report and Written Opinion dated Jan. 19, 2017 for PCT Patent Application No. PCT/US2016/057047.

Chinese Office Action dated Jan. 10, 2020 for Chinese Patent Application No. 201680060702.6.

Chinese Office Action dated Aug. 11, 2020 for Chinese Patent Application No. 201680060702.6.

* cited by examiner

MULTI-STAGE OIL BATCH BOILING SYSTEM

CROSS-REFERENCE TO RELATED APPLICATION

Benefit is claimed of U.S. Patent Application No. 62/241,994, filed Oct. 15, 2015, and entitled "Multi-Stage Oil Batch Boiling System", the disclosure of which is incorporated by reference herein in its entirety as if set forth at length.

BACKGROUND

The disclosure relates to refrigeration. More particularly, the disclosure relates to oil reclaim vaporizers for chiller systems.

In refrigeration systems such as chillers, it is known to use a vaporizer to separate refrigerant from a refrigerant/lubricant (oil) mixture. U.S. Pat. No. 6,672,102 of Huenniger et al. discloses a system wherein a vaporizer receives a refrigerant/lubricant mixture flow drained from an evaporator. The flow is mostly oil and it is desired to remove the refrigerant before returning the oil to lubricate the compressor. The flow is placed in heat exchange relation with a hot gas bypass flow passed from the compressor discharge to the evaporator. Vaporized refrigerant is passed to compressor suction and oil is drained to an oil sump to be returned to a compressor oil return port for lubrication (e.g., of bearings and rotors).

PCT/US2012/048562 of Molavi discloses an alternative vaporizer configuration. PCT/US2014/054193 of Molavi et al. discloses yet another alternative vaporizer configuration. The disclosures of these applications are incorporated by reference in their entireties herein as if set forth at length.

SUMMARY

One aspect of the disclosure involves a vapor compression system comprising: a compressor having a suction port and a discharge port; a refrigerant flowpath from the discharge port and returning to the suction port; a first heat exchanger along the refrigerant flowpath; a second heat exchanger along the refrigerant flowpath; and a vaporizer system. The vaporizer system comprises: a first vaporizer and a second vaporizer each comprising: a vessel having an inlet, a vapor outlet, and a liquid outlet; and a gas bypass flowpath in heat transfer relation with an interior of the vessel.

In one or more embodiments of any of the foregoing embodiments, the first vaporizer vessel and the second vaporizer vessel are separate vessels.

In one or more embodiments of any of the foregoing embodiments, the first vaporizer vessel and the second vaporizer vessel are each a metallic vessel having a cylindrical sidewall and domed end walls.

In one or more embodiments of any of the foregoing embodiments, a single tank with a partition forms, in common, the first vaporizer vessel and the second vaporizer vessel.

In one or more embodiments of any of the foregoing embodiments, a sump has a single vessel positioned to receive lubricant flow from the first vaporizer and the second vaporizer.

In one or more embodiments of any of the foregoing embodiments, the first vaporizer, the second vaporizer, and the sump each have an electric heater.

In one or more embodiments of any of the foregoing embodiments, the sump is a first sump, and the system further comprises: a second sump positioned to receive lubricant from the first sump.

In one or more embodiments of any of the foregoing embodiments, the first sump has a vent and the second sump does not have a vent.

In one or more embodiments of any of the foregoing embodiments, a pump is coupled to an outlet of the second sump along a lubricant supply flowpath to the compressor.

In one or more embodiments of any of the foregoing embodiments, one or more valves are positioned to provide: a first operational condition comprising draining lubricant from the first vaporizer while not draining lubricant from the second vaporizer; and a second operational condition comprising draining lubricant from the second vaporizer while not draining lubricant from the first vaporizer In one or more embodiments of any of the foregoing embodiments, the one or more valves comprise: a first three-way valve positioned to control flow to the inlets of the first vaporizer and the inlet of the second vaporizer; and a second three-way valve positioned to control flow from the liquid outlet of the first vaporizer and the liquid outlet of the second vaporizer.

In one or more embodiments of any of the foregoing embodiments, a controller is configured to provide: said first operational condition; and said second operational condition.

In one or more embodiments of any of the foregoing embodiments, the controller is further configured to provide: control of a pump for returning lubricant to the compressor.

In one or more embodiments of any of the foregoing embodiments, a method for using the system comprises: running the compressor to drive a refrigerant flow along the refrigerant flowpath, the refrigerant flow containing a lubricant; and diverting a flow of the refrigerant and lubricant to the vaporizer unit to alternatingly deliver the refrigerant and lubricant to the first vaporizer and the second vaporizer through the respective inlet thereof.

In one or more embodiments of any of the foregoing embodiments, the method further comprises: draining lubricant from the first vaporizer while not draining lubricant from the second vaporizer; and draining lubricant from the second vaporizer while not draining lubricant from the first vaporizer.

In one or more embodiments of any of the foregoing embodiments, the drainings from the first vaporizer and the second vaporizer are to a sump.

In one or more embodiments of any of the foregoing embodiments, the method further comprises pumping the drained lubricant back to the compressor.

In one or more embodiments of any of the foregoing embodiments, the draining of lubricant from the first vaporizer occurs while not introducing refrigerant via the inlet of said first vaporizer; and the draining of lubricant from the second vaporizer occurs while not introducing refrigerant through the inlet of the second vaporizer.

In one or more embodiments of any of the foregoing embodiments, the draining of lubricant from the first vaporizer occurs while not draining lubricant from the second vaporizer; and the draining of lubricant from the second vaporizer occurs while not draining lubricant from the first vaporizer.

In one or more embodiments of any of the foregoing embodiments, the method further comprises passing refrigerant through a conduit to transfer heat to refrigerant and lubricant in the first vaporizer and second vaporizer.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
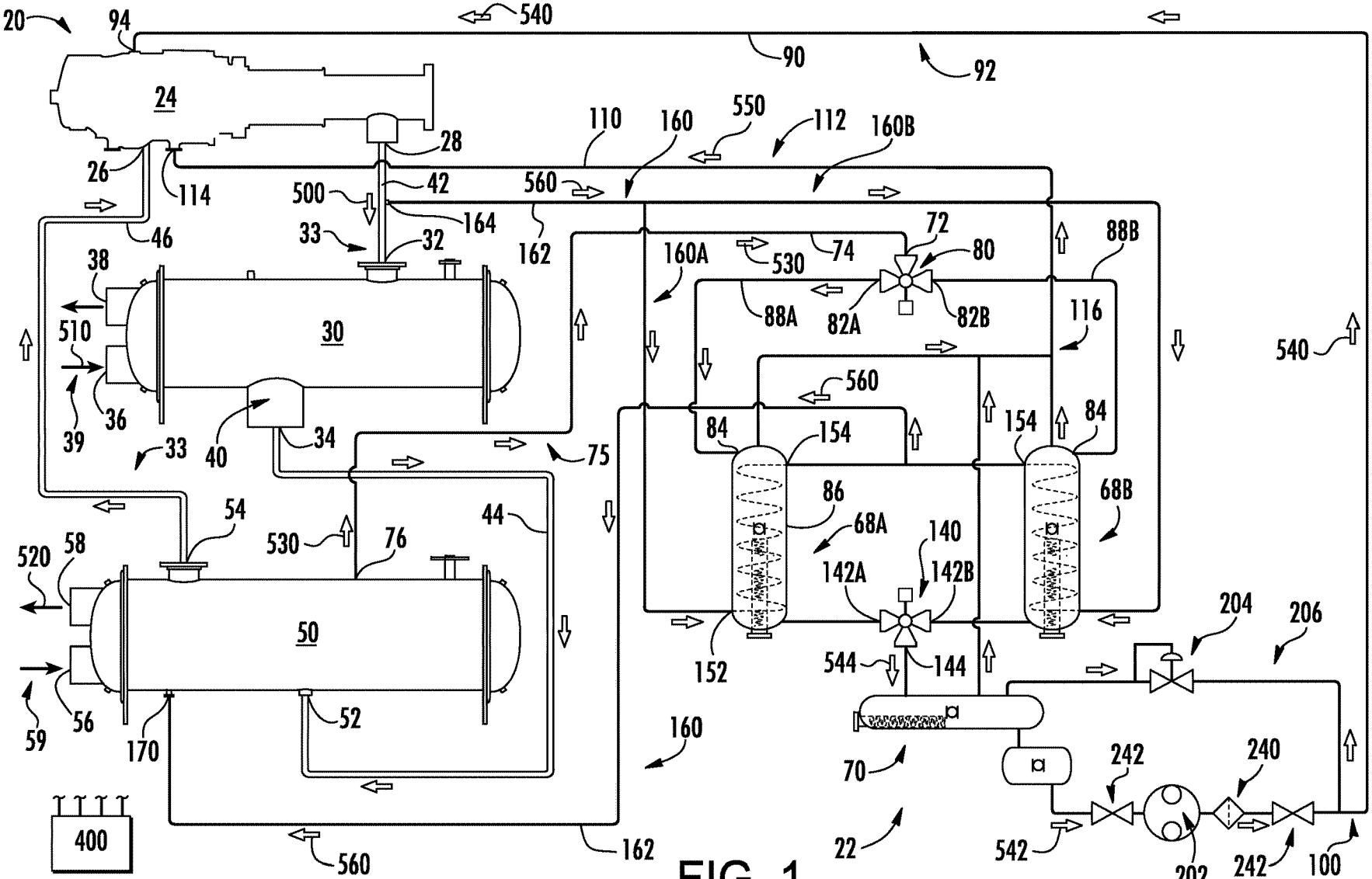
FIG. 1 is a partially schematic view of a chiller system.

FIG. 1 shows a vapor compression system (e.g., shown as a chiller) 20 including a vaporizer system 22. The system 20 includes a compressor 24 having a suction port 26 and a discharge port 28. An exemplary compressor 24 is a screw compressor having a hermetic electric motor (not shown) within a case. Alternative compressors are centrifugal compressors, scroll compressors, or reciprocating compressors. A condenser 30 has a gas/vapor inlet port 32 downstream of the discharge port 28 along a refrigerant primary flowpath 33 for a refrigerant primary flow 500. In operation, the compressor compresses refrigerant to drive a recirculating flow of refrigerant along the refrigerant primary flowpath 33 and branches off of it. The condenser has a liquid outlet 34 downstream along the refrigerant primary flowpath. The exemplary condenser is a liquid-cooled (e.g., water-cooled) condenser having a water inlet 36 and a water outlet 38 for water flow 510 passing along a water flowpath 39 through a tube bundle (not shown) in heat transfer relation with the refrigerant primary flow to absorb heat from the refrigerant to cool and condense the refrigerant. The condenser may be of any appropriate existing or yet-developed type. The exemplary condenser unit includes a float valve 40 which acts as an expansion device. Alternative implementations may include alternative expansion devices. A controller 400 (e.g., microprocessor based) may control operation of various components of the system 20 and may receive input from various sensors and user input devices.

Downstream of the condenser along the refrigerant primary flowpath 33 is an evaporator or cooler 50. The exemplary evaporator has a refrigerant inlet 52 and a refrigerant outlet 54 along the primary flowpath 33. The exemplary evaporator is used to chill a second heat transfer liquid (e.g., water) flow 520. Accordingly, the exemplary evaporator 50 has a water inlet 56 and a water outlet 58 along a water flowpath 59. Refrigerant passing along the refrigerant primary flowpath 33 through the evaporator is in heat exchange relation with the water (e.g., the water flowpath 59 passes through a tube bundle (not shown) over which the refrigerant flows) to absorb heat from the water (to cool the water). As with the condenser, the evaporator may represent any appropriate existing or yet-developed configuration. Additional evaporator ports cooperating with the vaporizer system 22 are discussed below.

There are several additional flowpaths through the vaporizer system 22 for passing refrigerant and/or lubricant (e.g., oil).

The exemplary vaporizer system 22 includes multiple (e.g., two shown) main vaporizer units 68A, 68B and an oil sump or reservoir 70. Depending upon context, the term "vaporizer" may designate the system 22 or the unit(s) 68A, 68B or the vaporizer chamber(s) discussed below.

The exemplary conduits or lines along the refrigerant primary flowpath 33 are a discharge line/conduit 42 between the discharge port 28 and the condenser inlet 32, an intermediate line/conduit 44 between the condenser outlet 34 and the evaporator inlet 52, and a suction line/conduit 46 between the evaporator outlet 54 and the suction port 26.

Figure 2:
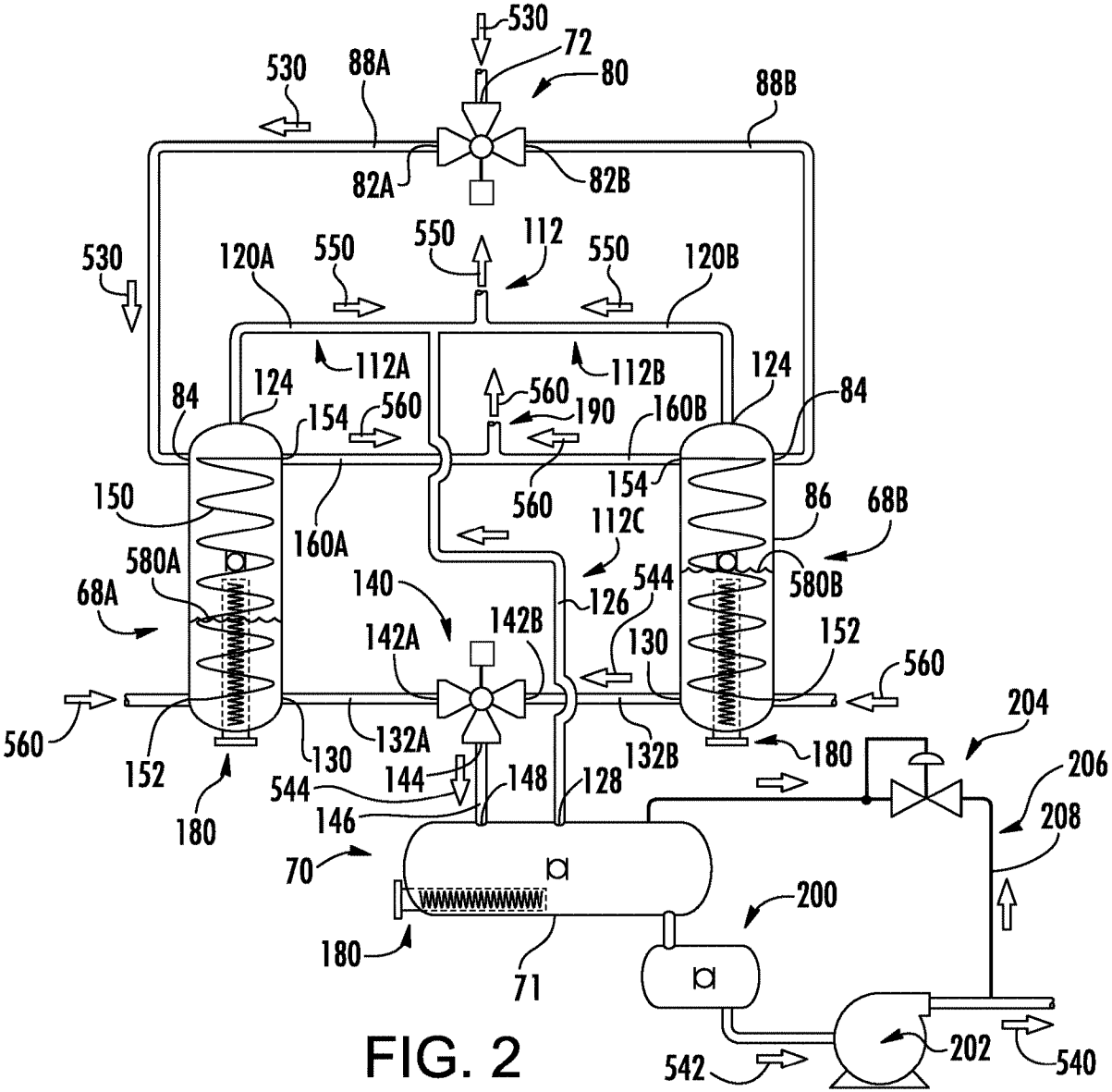
FIG. 2 is a partially schematic view of a vaporizer system within the chiller system of FIG. 1 in a first operational condition.

The exemplary system 22 has an inlet 72 (a main inlet) for receiving a refrigerant/oil mixture flow 530. The exemplary inlet 72 receives the mixture from the evaporator. The exemplary refrigerant/oil mixture passes along/through a skim line/conduit 74 along a mixture inlet flowpath 75 from a skim port (or group of ports) 76 on the evaporator. The exemplary inlet 72 is one port of an exemplary three-way valve 80 whose other two ports 82A, 82B are in respective communication with the individual main vaporizer units 68A, 68B via inlet ports 84 in the vessels 86 (e.g., dome-ended cylindrical tanks) of such main vaporizer units. FIG. 1 shows lines 88A, 88B extending from the valve 80 to the respective ports 84. The enlarged view of FIG. 2 shows respective surfaces 580A, 580B of liquid (principally refrigerant and oil with the percentage of oil increasing during heating) in the two vaporizer units 68A, 68B. Vapor (refrigerant and potentially contaminant) may exist in the headspace thereabove.

In addition to the line 74 and flowpath 75 for introducing the mixture of refrigerant and oil to the vaporizer system for separation, there are several return flowpaths. A line 90 and flowpath 92 may carry a lubricating flow 540 (e.g., majority by weight lubricant) back to the compressor (e.g., to a lubricant port 94 on the compressor housing). Depending on the particular compressor configuration, the lubricant flowpath 75 may branch to respective branches feeding compressor bearings and/or the working elements to lubricate their interface with each other or with fixed structure. As is discussed further below, the flowpath 92 may extend from a port 100 on the vaporizer system. The exemplary port 100 is along a second separation stage discussed below in which flow 542 drawn from the sump 70 may be more lubricant-rich than flow 544 delivered to the sump 70 from the main vaporizer units.

A refrigerant-rich flow 550 separated from the original mixed flow 530 may also be returned to the main flowpath 33. In the exemplary embodiment, this is done via a line 110 and flowpath 112 to an additional suction port 114 on the compressor. Alternative connections might be along the suction line 46.

The exemplary line 110 may extend from a port 116 on the vaporizer system. The flowpath 112 may reflect the merger of several branches upstream of the port 116. FIG. 2 shows respective lines 120A and 120B and associated branches 112A and 112B coming from vapor outlets 124 of the respective vaporizer units 68A, 68B. These flowpath branches merge with a branch 112C and line 126 from a vapor outlet 128 (vent) on a vessel 71 of the sump 70.

To withdraw lubricant (e.g., oil) from the vaporizer units 68A and 68B, each includes a liquid outlet 130 for passing a flow along an associated line 132A, 132B. The lines 132A and 132B pass to a valve (e.g., a three-way solenoid valve) 140 having respective associated ports 142A and 142B and a third port 144. The third port 144 is connected via a line 146 to an inlet port 148 of the vessel of the sump 70. The valve 140 may place the liquid outlets 130 of the two vaporizer units in alternative communication with the inlet port 148 to pass the flow 544 of mostly oil to the sump.

To supply heat to the vaporizer units 68A and 68B, two exemplary means are shown. The first means involves refrigerant-refrigerant heat exchange with refrigerant passing through a conduit 150 in heat exchange relation with refrigerant in the vessel interior to transfer heat to such refrigerant in the vessel interior to vaporize it. An exemplary conduit 150 is shown as a tubular coil within the vessel. One end of the coil is connected to an inlet 152 on the vessel and the other hand is connected to an outlet 154.

Returning to FIG. 1, a flowpath 160 is seen passing a refrigerant flow 560 through the coil from the main flowpath 33 and returning it to the main flowpath 33. The exemplary gas bypass flowpath 160 (bypassing the condenser 30) includes a line 162 extending from a location (e.g., port) along the main flowpath 33. The exemplary location is along the discharge line. However, other locations may include from the condenser vessel. The flowpath separates into respective branches 160A and 160B to feed the respective ports 152 of the two vaporizers 68A and 68B. Downstream of the outlets 154, the flowpath branches merge to return to the main flowpath 33. An exemplary return is at a port 170 on the cooler from a port 190 (FIG. 2) of the vaporizer system.

FIG. 2 further shows continuous flow 560 along both branches 160A and 160B. In alternative implementations, one or more valves (not shown) may be provided to control flow. In one example, a valve which may be otherwise similar to the valves 80 and 140 may be at a junction of the branches 160A and 160B. The valve may have respective ports for receiving the flow 560 from the branches 160A and 160B. The valve may have a port for returning the flow 560 to the port 170. The valve may be configured to allow alternative communication from either of its two branch port to its trunk port. It may additionally have other modes such as placing all three ports in communication with each other or blocking all communication. In another alternative, a single valve is positioned away from the branches to provide intermittent simultaneous flow.

FIG. 2 further shows additional heating means in the form of electric heaters 180. Each of the two vaporizer units 68A, 68B includes such a heater 180, as does the sump 70. The exemplary configuration orients the elongate vessels of the vaporizer units vertically with the heater 180 centrally located extending upward from a lower end of the vessel. The exemplary configuration orients the elongate vessel 71 of the sump 70 horizontally with the heater 180 oriented horizontally at a lower portion of the vessel. This serves to heat the liquid accumulation in the bottom of the sump vessel 71 to more fully vaporize/volatilize the refrigerant or contaminant to discharge it through the vapor outlet 128.

FIG. 2 also shows secondary sump 200 and pump 202 along the flowpath 92 upstream of the outlet 100. FIG. 2 further shows a pressure regulator 204 along a bypass flowpath 206 and line 208 extending from downstream of the pump 202 back to a port on the sump vessel 71. If the pressure difference across the pump exceeds a threshold value, the pressure regulator 204 allows a flow from the pump outlet back to the sump 70 to relieve that pressure. This prevents the compressor from being exposed to excessive lubricant pressure.

Returning to FIG. 1, the exemplary vaporizer system 22 also includes a lubricant filter 240 and a pair of shutoff valves 242 allowing servicing of the pump 202 and filter.

Via actuation of valves (e.g., 80 and 140 in the exemplary embodiment) the system may be shifted between two or more modes. For example, two of these modes may represent the alternating operational stages of a batch process wherein sequential batches of lubricant are alternatingly separated in the respective vaporizers 68A, 68B and delivered to the sump 70.

The exemplary FIG. 2 condition involves the vaporizer 68B discharging a flow 544 of oil from its port 130 through the valve 140 to the sump 70. While this is happening, the vaporizer 68A receives a fresh charge of refrigerant and lubricant via the flow 530 entering the port 84 through the valve 80. The vaporizer 68B had already received a charge of refrigerant and oil and, therefore, may largely have completed the process of boiling off refrigerant vapor 550. The exemplary FIG. 2 condition shows simultaneous flows 550 of vapor from both vaporizers. In practice, the flow rate will vary based upon the temperature and ratio of mixture in each of the vaporizers. In alternative embodiments, additional valves may be provided to allow only one such flow.

In the FIG. 2 condition, the valve 80 is set so that the flow 530 is passed to the vaporizer 68A but not the vaporizer 68B. Similarly, the valve 140 is set so that the flow 544 passes from the vaporizer 68B with similar drain flow being blocked from the vaporizer 68A. Thus, in this example, the flow 530 entering the vaporizer will immediately begin to be heated and boil. If the hot gas flow 560 is insufficient (e.g., if lift is lower than a threshold value such as 22.5° F. (12.5° C.)) the electric heater will also be used in the vaporizer where boiling is occurring.

Figure 3:
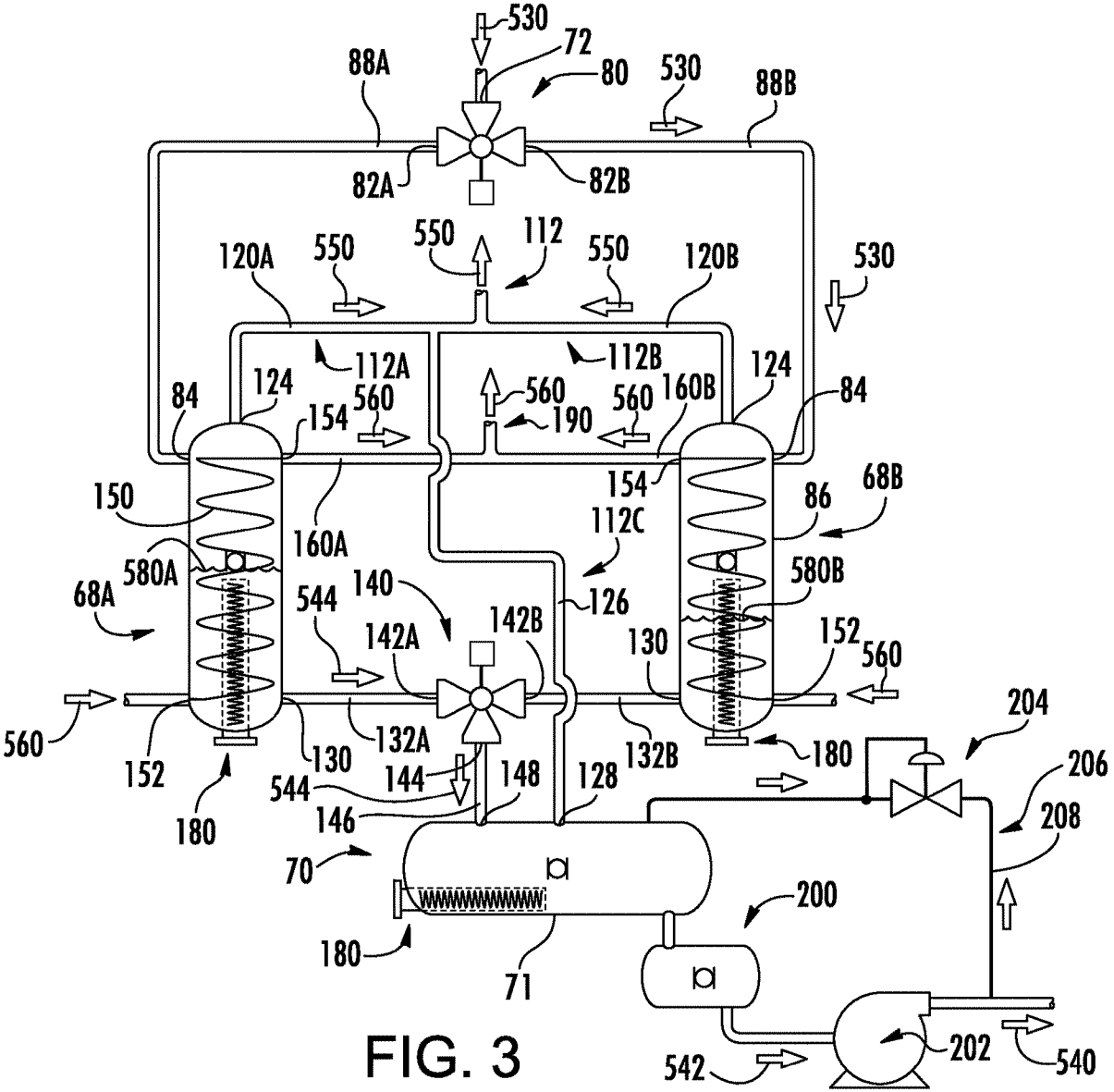
FIG. 3 is a partially schematic view of the vaporizer system in a second operational condition.

In the FIG. 3 condition, however, the valve states are reversed so that the roles of the two vaporizers 68A, 68B are reversed. In the FIG. 2 condition, refrigerant is being boiled off the mixture in the vaporizer 68A leading to increased oil concentration in the liquid accumulation at the bottom of the vessel 86 of such vaporizer 68A. The vaporizer 68B had already completed sufficient boiling. Once relatively pure oil has been expended from the vaporizer 68B or once the vaporizer 68A has completed filling with liquid, the valves may be shifted to the second mode to initiate the FIG. 3 draining of oil from the vaporizer 68A and recharging of the vaporizer 68B.

In addition to the operational mode of the system 20 described, there may be additional modes. In addition to the conditions described for an individual one of the vaporizer units 68A, 68B, other conditions may be provided. There may also be transitory conditions between modes and other conditions such as startup and shutdown in which parameters change. For example, there may be implementations with three or more vaporizer units in place of the two units shown. If two of the three were in conditions discussed above, the third could be in a different condition (e.g., each unit could cycle through three or more operational conditions in a given operational mode of the overall system 20).

Figure 5:
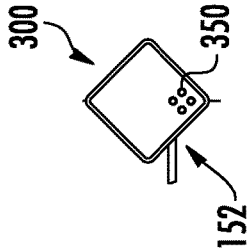
FIG. 5 is a sectional view of a vaporizer unit of the vaporizer system of the second vaporizer system taken along line 5-5 of FIG. 4.
Figure 4:
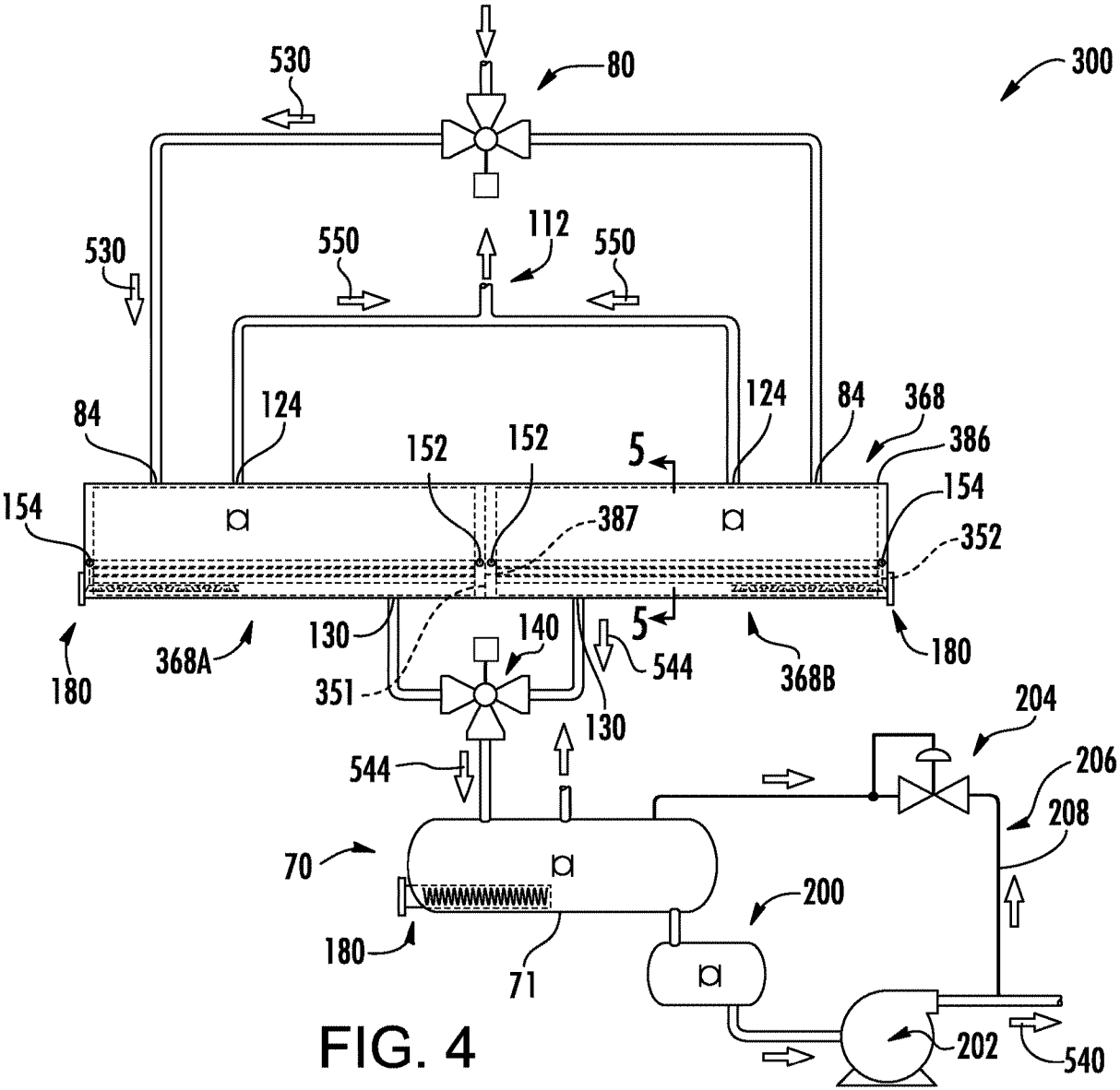
FIG. 4 is a partially schematic view of a second vaporizer system in a first operational condition.
Figure 6:
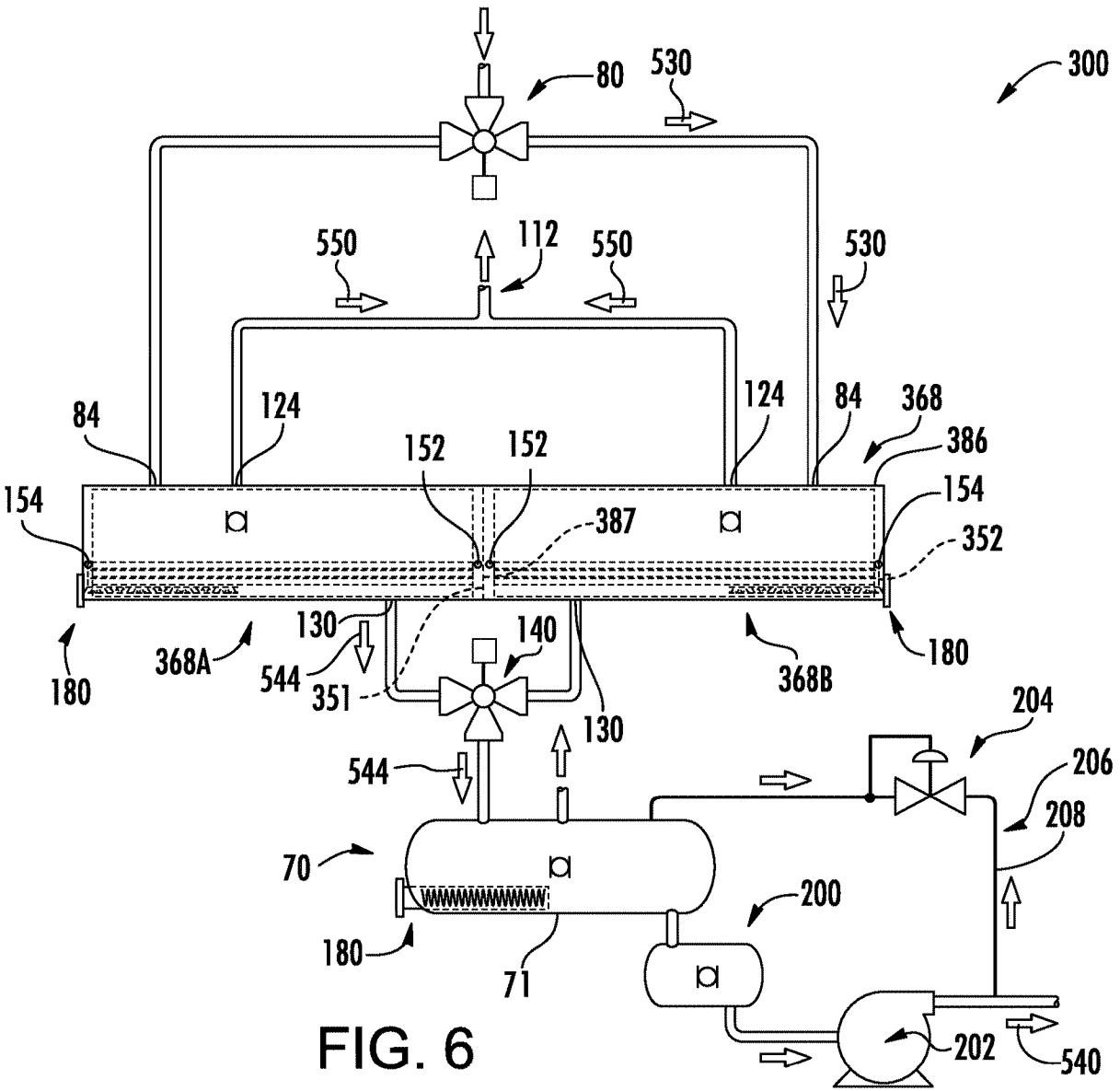
FIG. 6 is a partially schematic view of the second vaporizer system in a second operational condition.

FIGS. 4-6 show a system vaporizer 300 based upon the configuration of vaporizer shown in PCT/US2014/054193.

In the system 300, the two units 368A and 368B are formed as portions of a single larger unit 368 with a single main vessel 386 having a dividing wall or partition 387 to divide the vessel into individual vessels associated with the individual units. FIG. 5 shows the vessel cross-section as being generally square (e.g., with one square metallic tube stock). The exemplary vessel 386 has flat endplates at respective ends.

A further difference relative to the units 68A, 68B is that the spiral or coiled conduit 150 is replaced by a bundle of tubes 350 fluidically in parallel with each other between an inlet manifold 351 and an outlet manifold 352. The exemplary manifolds are formed by plates spanning the cross-section of the vessel sidewall spaced slightly inboard of the respective endplate of the associated unit 368A, 368B and the central partition 387. Otherwise, the illustrated ports, connections, and other components may be similar to those of the vaporizer system 22 as discussed above.

FIG. 1 further shows the controller 400. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

In one exemplary control implementation, the controller may receive inputs from liquid level sensors (not shown) in the various vessels. The controller 400 may be programmed for changeover between the two vaporizers 68A and 68B when the liquid level in the vaporizer that is filling reaches a given threshold. Other control methodologies are possible.

The systems 20 and 300 may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system (20) comprising:
- a compressor (24) having a suction port (26) and a discharge port (28);
- a refrigerant flowpath (33) from the discharge port and returning to the suction port;
- a first heat exchanger (30) along the refrigerant flowpath;
- a second heat exchanger (50) along the refrigerant flowpath; and
- a vaporizer system (22; 300), wherein:
- the vaporizer system comprises:
  - a first vaporizer (68A; 368A) comprising:
    - a vessel (86; 386) having an inlet (84), a vapor outlet (124), and a liquid outlet (130); and
    - a gas bypass flowpath branch (160A) in heat transfer relation with an interior of the first vaporizer vessel;
  - a second vaporizer (68B; 368B) comprising:
    - a vessel (86; 386) having an inlet (84), a vapor outlet (124), and a liquid outlet (130); and
    - a gas bypass flowpath branch (160B) in heat transfer relation with an interior of the second vaporizer vessel; and
  - one or more valves (80, 140) positioned to provide:
    - a first operational condition comprising draining lubricant (544) from the first vaporizer while not draining lubricant from the second vaporizer; and
    - a second operational condition comprising draining lubricant (544) from the second vaporizer while not draining lubricant from the first vaporizer.

2. The system of claim 1 wherein:
- the first vaporizer vessel and the second vaporizer vessel are separate vessels (86).

3. The system of claim 1 wherein:
- the first vaporizer vessel and the second vaporizer vessel are each a metallic vessel (86) having a cylindrical sidewall and domed end walls.

4. The system of claim 1 wherein:
- a single tank (386) with a partition (387) forms, in common, the first vaporizer vessel and the second vaporizer vessel.

5. The system of claim 1 further comprising:
- a sump (70) having a single vessel (71) positioned to receive lubricant flow from the first vaporizer and the second vaporizer.

6. The system of claim 5 wherein:
- the first vaporizer, the second vaporizer, and the sump each have an electric heater (180).

7. The system of claim 5 wherein the sump is a first sump, and the system further comprises:
- a second sump positioned to receive lubricant from the first sump.

8. The system of claim 7 wherein:
- the first sump has a vent (128) and the second sump does not have a vent.

9. The system of claim 7 further comprising:
- a pump (202) coupled to an outlet of the second sump along a lubricant supply flowpath (92) to the compressor.

10. The system of claim 1 wherein the one or more valves (80, 140) comprise:
- a first three-way valve (80) positioned to control flow to the inlet (84) of the first vaporizer and the inlet (84) of the second vaporizer; and
- a second three-way valve (140) positioned to control flow from the liquid outlet (130) of the first vaporizer and the liquid outlet (130) of the second vaporizer.

11. The system of claim 1 further comprising a controller (400) configured to provide:
- said first operational condition; and
- said second operational condition.

12. The system of claim 11 wherein the controller is further configured to provide:
- control of a pump for returning lubricant to the compressor.

13. A method for using the system of claim 1, the method comprising:

running the compressor (24) to drive a refrigerant flow (500) along the refrigerant flowpath (33), the refrigerant flow containing a lubricant; and diverting a flow (530) of the refrigerant and lubricant to the vaporizer system to alternatingly deliver the refrigerant and lubricant to the first vaporizer through the inlet (84) of the first vaporizer and the second vaporizer through the inlet (84) of the second vaporizer.

14. The method of claim 13 wherein:

the running the compressor (24) to drive the refrigerant flow (500) along the refrigerant flowpath (33) operates the first heat exchanger as a condenser and the second heat exchanger as an evaporator.

15. A method for using a vapor compression system (20), the vapor compression system comprising:

a compressor (24) having a suction port (26) and a discharge port (28);

a refrigerant flowpath (33) from the discharge port and returning to the suction port;

a first heat exchanger (30) along the refrigerant flowpath;

a second heat exchanger (50) along the refrigerant flowpath; and a vaporizer system (22; 300), wherein:

the vaporizer system comprises:

a first vaporizer (68A; 368A) comprising:

a vessel (86; 386) having an inlet (84), a vapor outlet (124), and a liquid outlet (130); and a gas bypass flowpath branch (160A) in heat transfer relation with an interior of the first vaporizer vessel; and a second vaporizer (68B; 368B) comprising:

a vessel (86; 386) having an inlet (84), a vapor outlet (124), and a liquid outlet (130); and a gas bypass flowpath branch (160B) in heat transfer relation with an interior of the second vaporizer vessel, the method comprising:

running the compressor (24) to drive a refrigerant flow (500) along the refrigerant flowpath (33), the refrigerant flow containing a lubricant;

diverting a flow (530) of the refrigerant and lubricant to the vaporizer system to alternatingly deliver the refrigerant and lubricant to the first vaporizer through the inlet (84) of the first vaporizer and the second vaporizer through the inlet (84) of the second vaporizer;

draining lubricant (544) from the first vaporizer while not draining lubricant from the second vaporizer; and draining lubricant (544) from the second vaporizer while not draining lubricant from the first vaporizer.

16. The method of claim 15 wherein:

the drainings from the first vaporizer and the second vaporizer are to a sump (70).

17. The method of claim 15 further comprising:

pumping the drained lubricant back to the compressor.

18. The method of claim 15 wherein:

the draining of lubricant from the first vaporizer occurs while not introducing refrigerant via the inlet of said first vaporizer; and the draining of lubricant from the second vaporizer occurs while not introducing refrigerant through the inlet of the second vaporizer.

19. The method of claim 15 wherein:

the draining of lubricant from the first vaporizer occurs while not draining lubricant from the second vaporizer; and the draining of lubricant from the second vaporizer occurs while not draining lubricant from the first vaporizer.

20. A method for using a vapor compression system (20), the vapor compression system comprising:

a compressor (24) having a suction port (26) and a discharge port (28);

a refrigerant flowpath (33) from the discharge port and returning to the suction port;

a first heat exchanger (30) along the refrigerant flowpath;

a second heat exchanger (50) along the refrigerant flowpath; and a vaporizer system (22; 300), wherein:

the vaporizer system comprises:

a first vaporizer (68A; 368A) comprising:

a vessel (86; 386) having an inlet (84), a vapor outlet (124), and a liquid outlet (130); and a gas bypass flowpath branch (160A) in heat transfer relation with an interior of the first vaporizer vessel; and a second vaporizer (68B; 368B) comprising:

a vessel (86; 386) having an inlet (84), a vapor outlet (124), and a liquid outlet (130); and a gas bypass flowpath branch (160B) in heat transfer relation with an interior of the second vaporizer vessel, the method comprising:

running the compressor (24) to drive a refrigerant flow (500) along the refrigerant flowpath (33), the refrigerant flow containing a lubricant;

diverting a flow (530) of the refrigerant and lubricant to the vaporizer system to alternatingly deliver the refrigerant and lubricant to the first vaporizer through the inlet (84) of the first vaporizer and the second vaporizer through the inlet (84) of the second vaporizer;

passing refrigerant (560) through a conduit (150) of the first vaporizer to transfer heat to refrigerant and lubricant in the first vaporizer; and passing refrigerant (560) through a conduit (150) of the second vaporizer to transfer heat to refrigerant and lubricant in the second vaporizer.

21. The method of claim 20 wherein:

the conduit of the first vaporizer is along the gas bypass flowpath branch of the first vaporizer;

the conduit of the second vaporizer is along the gas bypass flowpath branch of the second vaporizer; and the gas bypass flowpath branch of the first vaporizer and the gas bypass flowpath branch of the second vaporizer branch upstream of the first vaporizer and second vaporizer and merge downstream of the first vaporizer and second vaporizer.

* * * * *